US006196010B1

(12) United States Patent
Mohrman

(10) Patent No.: US 6,196,010 B1
(45) Date of Patent: Mar. 6, 2001

(54) TEMPERATURE CONTROL ZONE FOR COMPRESSOR/CONDENSER AIR INTAKE

(76) Inventor: John Harry Mohrman, 301 Village Rd., Orwigsburg, PA (US) 17961

( * ) Notice: Subject to any disclaimer, the term of this patent is extended or adjusted under 35 U.S.C. 154(b) by 0 days.

(21) Appl. No.: 09/318,113

(22) Filed: May 25, 1999

Related U.S. Application Data

(60) Provisional application No. 60/088,046, filed on Jun. 3, 1998.

(51) Int. Cl.[7] ..... F25B 39/04

(52) U.S. Cl. ..... 62/184; 62/186; 62/235.1; 62/238.7; 62/508

(58) Field of Search ..... 62/183, 184, 181, 62/428, 186, 235.1, 238.1, 238.6, 238.7, 506, 507, 508

(56) References Cited

U.S. PATENT DOCUMENTS 3,584,466 * 6/1971 Kaufman ..... 62/163
3,759,056 * 9/1973 Graber ..... 62/183
4,317,334 * 3/1982 Burgess ..... 62/183

* cited by examiner

*Primary Examiner*—William Doerrler
*Assistant Examiner*—Marc Norman

(57) ABSTRACT

A temperature control zone enclosure for exterior compressor/condensers has been developed to serve as a means of protecting the compressor/condensers from inclement weather and to automatically allow those units to operate at optimum temperature. The enclosure is comprised of a back, two sides and partial front and top walls with rigid insulation sandwiched between an outer and inner layer of material impervious to atmospheric conditions. The majority of the front and slanted top of the enclosure is comprised of two movable dual-glazed panels. Those movable panels are equipped with automatically operating interior light-reflecting horizontal slat blinds that change position in concert with the moveable dual-glazed panels that are operated by a non-electric temperature sensing operating device connected to the panels by a set of fulcrum advantaged rigid members activated as temperatures rise or fall within the enclosure. When the two movable dual-lazed panels are closed, the horizontal slat blinds are open, and when the dual-glazed panels are open, the horizontal slat blinds are closed. The enclosure also contains interconnected sections of piping containing non-freezing liquid which is tempered by means of tubing and a temperature extractor in communication between those piping sections and the main line emanating from the compressor/condenser that enters the building or facility. Such liquid filled sections of piping-serve to store the tempered liquid to assist in maintaining an ambient temperature within the enclosure thereby causing minimum operating time of the compressor/condensers.

6 Claims, 7 Drawing Sheets

TEMPERATURE CONTROL ZONE FOR COMPRESSOR/CONDENSER AIR INTAKE

CROSS-REFERENCE TO RELATED APPLICATIONS

Provisional application No. 60/088,046, filing date Jun. 3, 1998 in part; Burgess (U.S. Pat. No. 4,317, 334); Kaufman (U.S. Pat. No. 3,584,466) and Graber (U.S Pat. No. 3,759, 056).

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION

This invention relates to a temperature control enclosure for exterior compressor/condensers used for air conditioning and heat pumps that will automatically allow those units to operate at air temperatures as close to the optimum temperature.

Heretofore, out-of-doors compressors/condensers for air conditioning and/or heat pumps have been subjected to all seasonal weather conditions. As a result, those operating units functioned relatively inefficiently, when extreme hot or cold atmospheric temperatures occurred, thus requiring the units to operate for longer periods of time to attain the desired interior housing facility temperatures. In cold or freezing temperatures, particularly those operating units for heat pumps were relatively inefficient. It is well known that the present state-of-the-art for those exterior units, when in use specifically for heat pumps, can no longer operate to provide any heat input when a specific low exterior air temperature is reached. Such units stop operating at specific low temperatures, known as their balance points, and the interior facility ambient temperature must then be maintained by means of electrical resistance heater(s) located within the system, which are extremely costly to operate and are considered to be emergency heating sources. Disabling of the compressor/condensers occurs when the temperature sensors on the operating unit(s) freeze-up, or when snow or ice cover prevents adequate air circulation through the unit.

Frequently, compressor/condenser manufactures will issue installation instructions for those exterior units indicating that such units should be installed at a minimum height above the surface on which they rest so as to exceed the particular predicted area annual maximum snowfall height. When severe unusual snowfall conditions occur, such manufacturer's information has been found to be ineffective in that the snow and ice must still be cleared from the operating unit for it to operate. All of those extreme weather conditions contribute to excessive electric service costs and shorten the "life-expectancy" of the compressor/condensers.

BRIEF SUMMARY OF THE INVENTION

The purpose of the present invention is to shelter exterior compressors/condensers from severe atmospheric conditions, during any and all seasons, and to control the temperature of air flowing through those operating units to obtain the maximum operating efficiency during all such seasons by providing a temperature control enclosure.

Specifically, as exterior temperature increases occur, the non-electrical temperature sensing device operates to allow adequate ventilation of the enclosure while minimizing the entry of natural light into the enclosure by closed horizontal slat blinds to ensure that the air passing through the compressor/condenser is as cool as possible for operation of those units. During relatively cold or frigid temperatures, i.e. below 40 degrees F., the enclosure allows re-circulation of the air which is being partially warmed by maximum entry of natural light, or sunlight entering through transparent glass panes on top and front of the enclosure and through attached open horizontal slat blinds, and by radiant heat emanating from a nonfreezing liquid filled piping reservoir that is mounted on three insulated walls of the interior of the enclosure. The non-freezing liquid in that piping is heated (or cooled) by a device which extracts heat (or cold) from the main compressor/condenser conduit entering the facility and feeds such tempered liquid by separate conduit means to the piping reservoir mounted on the insulated enclosure.

According to this invention, there is provided an upstanding multi-sided enclosure having a roof comprised of a small horizontal insulated wall-like section along with a slanted thermal glazed movable front section and a horizontal thermal dual-glazed front section, the structure being adapted in size and function as a temperature control enclosure for out-of-doors components of a housing air conditioning and/or heat pump system, and further provided with integral means for internal ambient temperature regulation about the enclosed air conditioning and/or heat pump elements, further comprising:

(a) an upstanding elongate rectangular framing assembly comprised of rigid linear elements all the variable lengths adapted to be securely attached to one another along their longitudinal ends;

(b) a plurality of planar side walls mounted on the framing assembly so as to form closed linear edges along the vertical corners of the assembly;

(c) a slanted-topped structure sized to engage seatingly along its own periphery with the upper rectangular periphery of the conjoined side walls, the slanted top and front wall comprising planar, rectangular segments conjoined along their linear edges, and further comprising transparent materials of construction, such as shatter-proof, glazed glass or polyacrylate plastic;

(d) a first angular panel located in the slanted top of the enclosure in contact with at least three of the side walls, equipped with a swivel axis and hinged together along one linear dimension thereof with a second front wall panel also in contact with at least three of the side walls and equipped with a swivel axis, both panels to be caused to open or closed by an associated control means and those panels further equipped with means to minimize or maximize natural light infiltration into the enclosure;

(e) a first rigid member pivotally interconnecting the hinged slanted top and front movable panels with a point of attachment on the conjoined hinge, and adapted to pull each linear dimensioned end of both panels inwardly into the enclosure thereby allowing the non-hinged unattached uppermost linear dimension of the top slanted panel and the lowermost linear dimension of the front panel to move outwardly to an open position and also forcing the inner horizontal slatted blinds to close;

(f) a second rigid member pivotally interconnecting the first rigid member and a temperature sensing operating device extension arm, with said interconnecting rigid member swiveling on a lateral fulcrum advantaged pivot point, and such pivot point being located along and attached to an "L"-shaped angle member extending horizontally and mounted on the structural frame of the enclosure on two sides;

(g) a nonelectric temperature sensing operating device attached to the L-shaped angle member, having an extension arm that is activated by ambient temperature sensing means located within the temperature sensing operating device and adapted to respond to preset upper and lower temperature limits, moving the second rigid member pivotally in conjunction with the first rigid member to cause the top and front panel to swivel inwardly or outwardly as temperatures change within the enclosure, subsequently, causing either exterior air to flow through the enclosure or air within the enclosure to be re-circulated.

The present temperature control zone enclosure consists of a four-sided square or rectangular structure with a small flat section and a larger sloping section forming the roof. A skeletal rigid frame of structural members, e.g. light metallic beams, supports attachable insulated wall sections and the slanted window-like thermal glazed moveable section and flat wall-like section forming the roof. Three of the walls are composed of a like inner and outer layer of a rigid material impervious to seasonal weather conditions, e.g. sheet aluminum, with an insulation material layer sandwiched between those inner and outer layers. The fourth and front wall of the enclosure is composed of a lower smaller portion composed of the same material as in the other three walls while the larger remaining portion is a window-like thermal glazed movable panel.

DETAILED DESCRIPTION OF THE INVENTION

Figure 1:
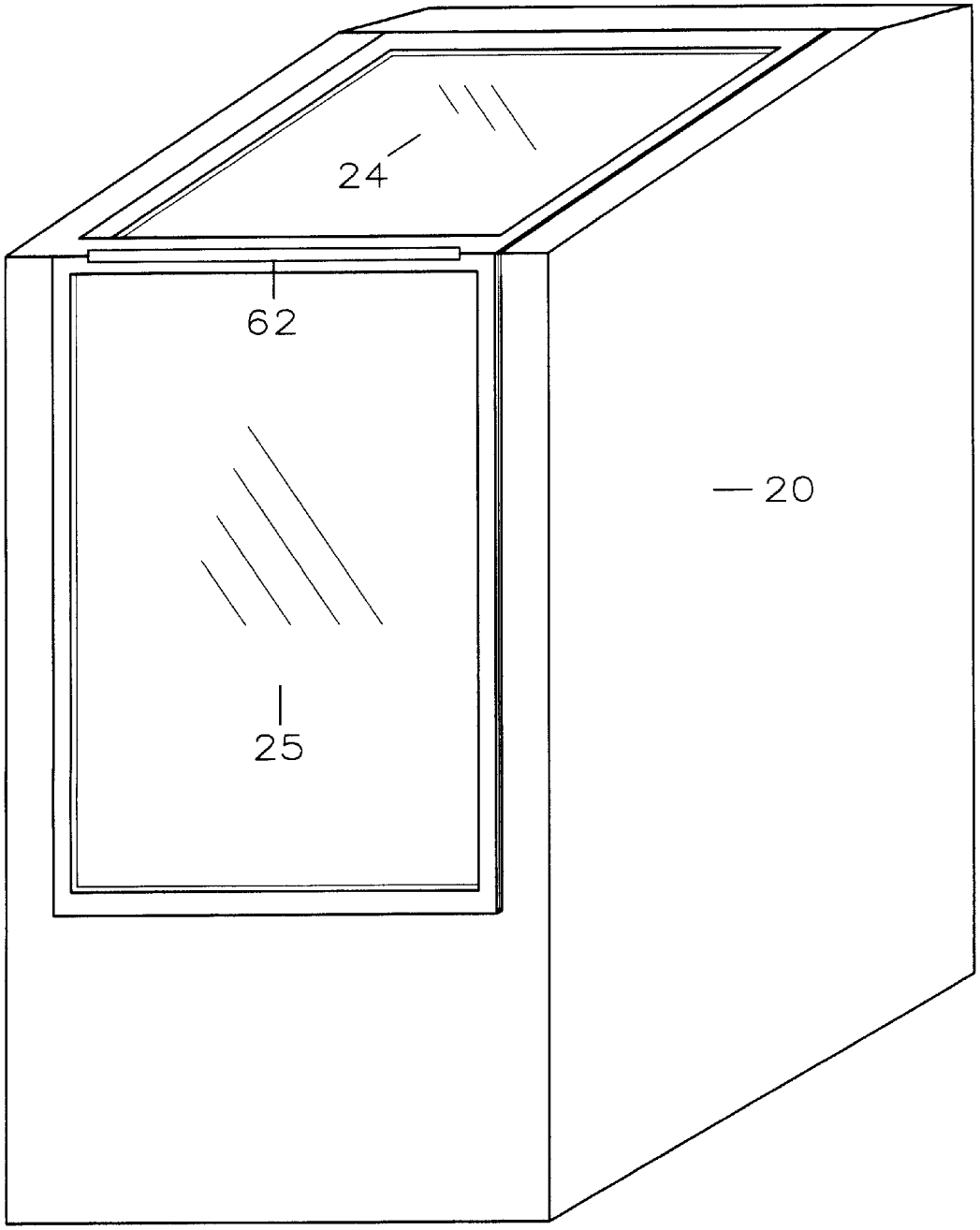
FIG. 1 is a perspective view of the upstanding exterior of the temperature control zone of the enclosure of the present invention.
Figure 2:
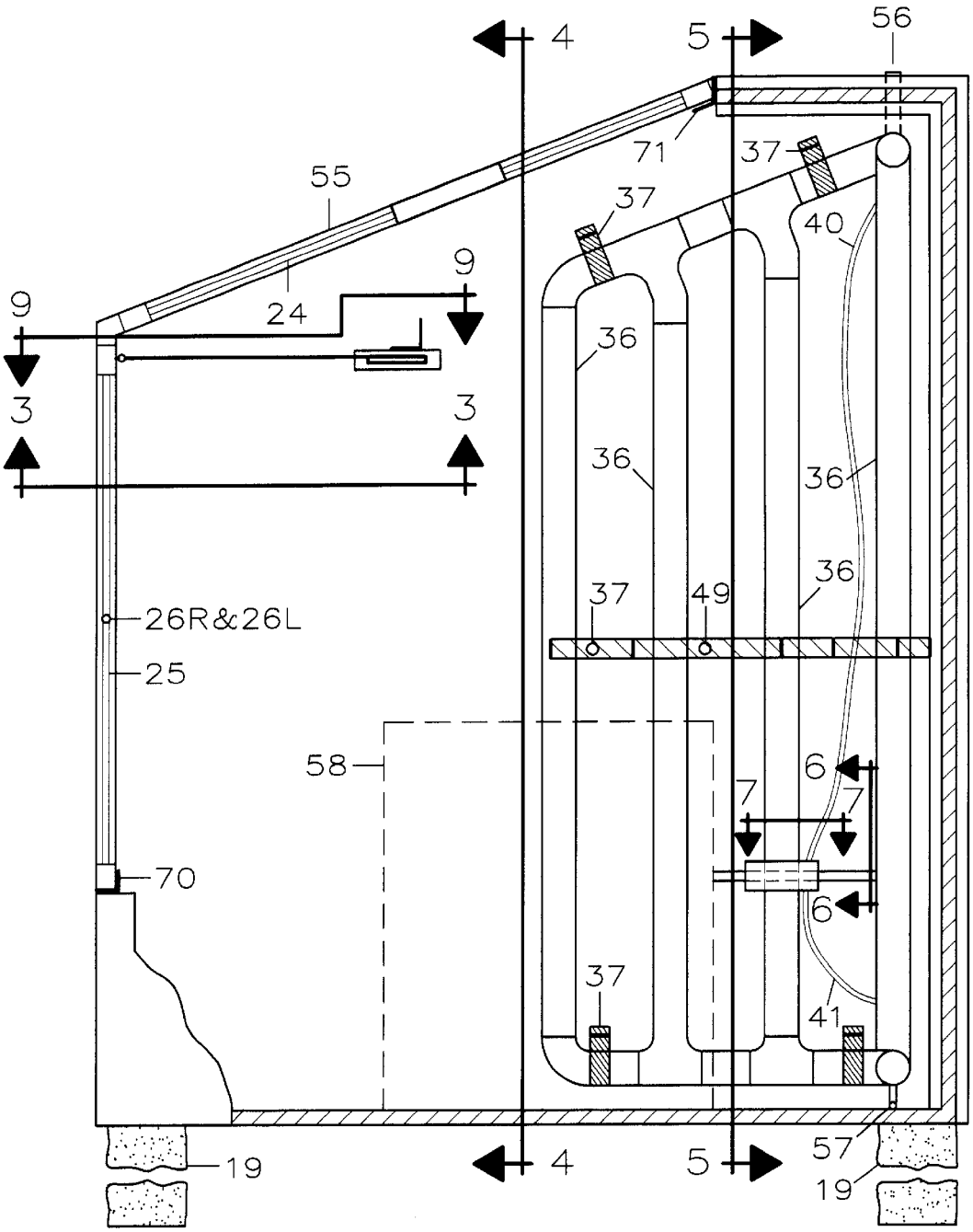
FIG. 2 is a schematic side plan view of all of the components, except the light reflecting components, of the temperature control zone enclosure, depicting the location of the enclosure construction and all operating elements.
Figure 6:
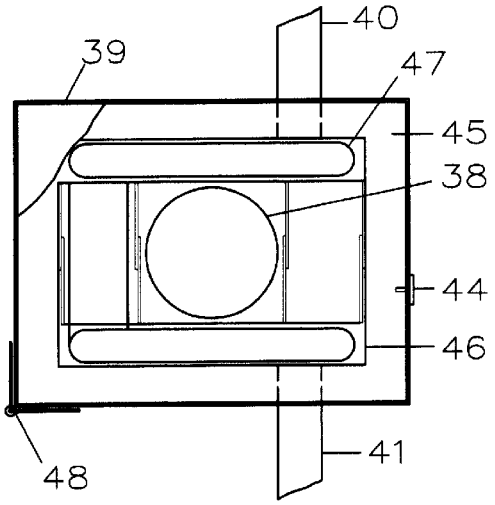
FIG. 6 is a detailed vertical sectional view of the temperature extractor taken along line 6—6 of FIG. 2, depicting the most effective temperature transmission tubing and folding housing which encloses the main piping from compressor/condenser that enters the building or facility, and the hinged application to allow installation.
Figure 3:
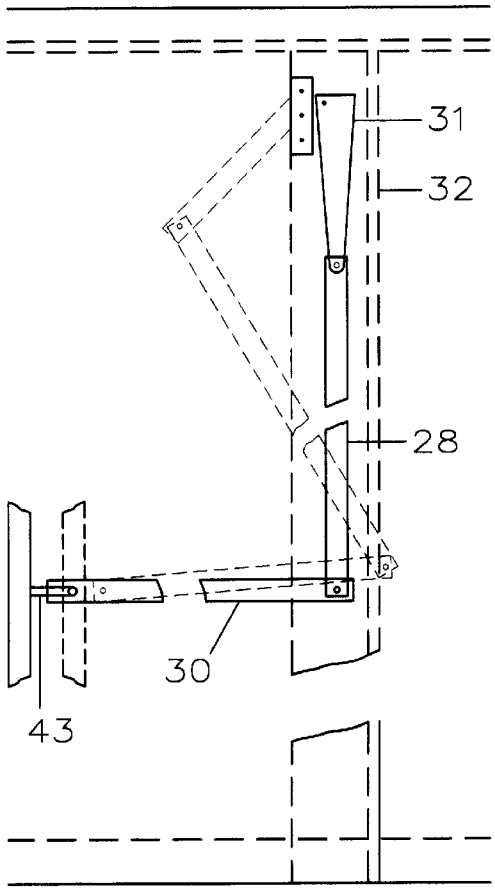
FIG. 3 is a detailed schematic bottom view taken along line 3—3 of FIG. 2, of the structural member support and the rigid members of the operating linkage as activated by the non-electric powered temperature sensing control device shown by solid lines as the unvented configuration and by the phantom lines as the vented configuration of the enclosure.
Figure 7:
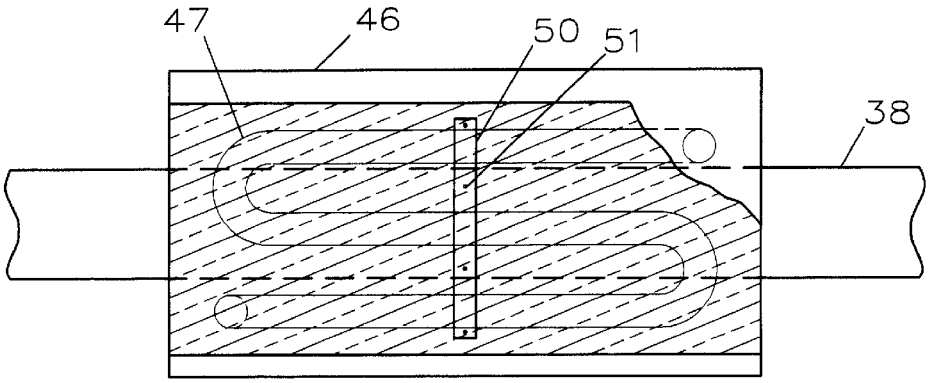
FIG. 7 is a broken out, plan view taken along line 7—7 of FIG. 2, of the temperature extractor depicted in place on the main piping from the compressor/condenser which supplies tempered means to cool or heat the facility or building.
Figure 4:
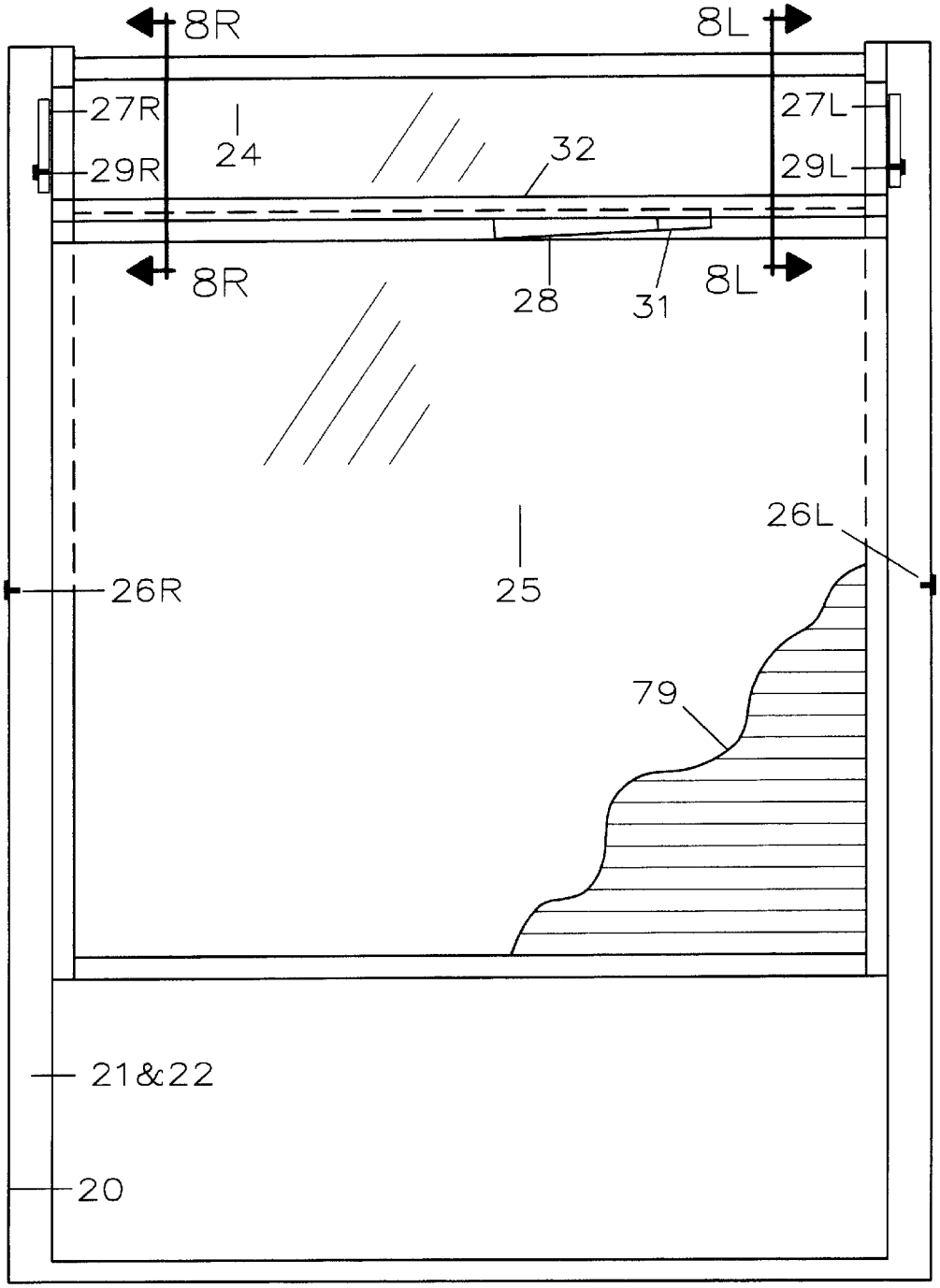
FIG. 4 is a detailed vertical sectional view taken along line 4—4 of FIG. 2, depicting the operating dual-glazed venting conjoined movable sections, the bottom wall section and other components of the slanted top and front of the temperature control zone enclosure.
Figure 5:
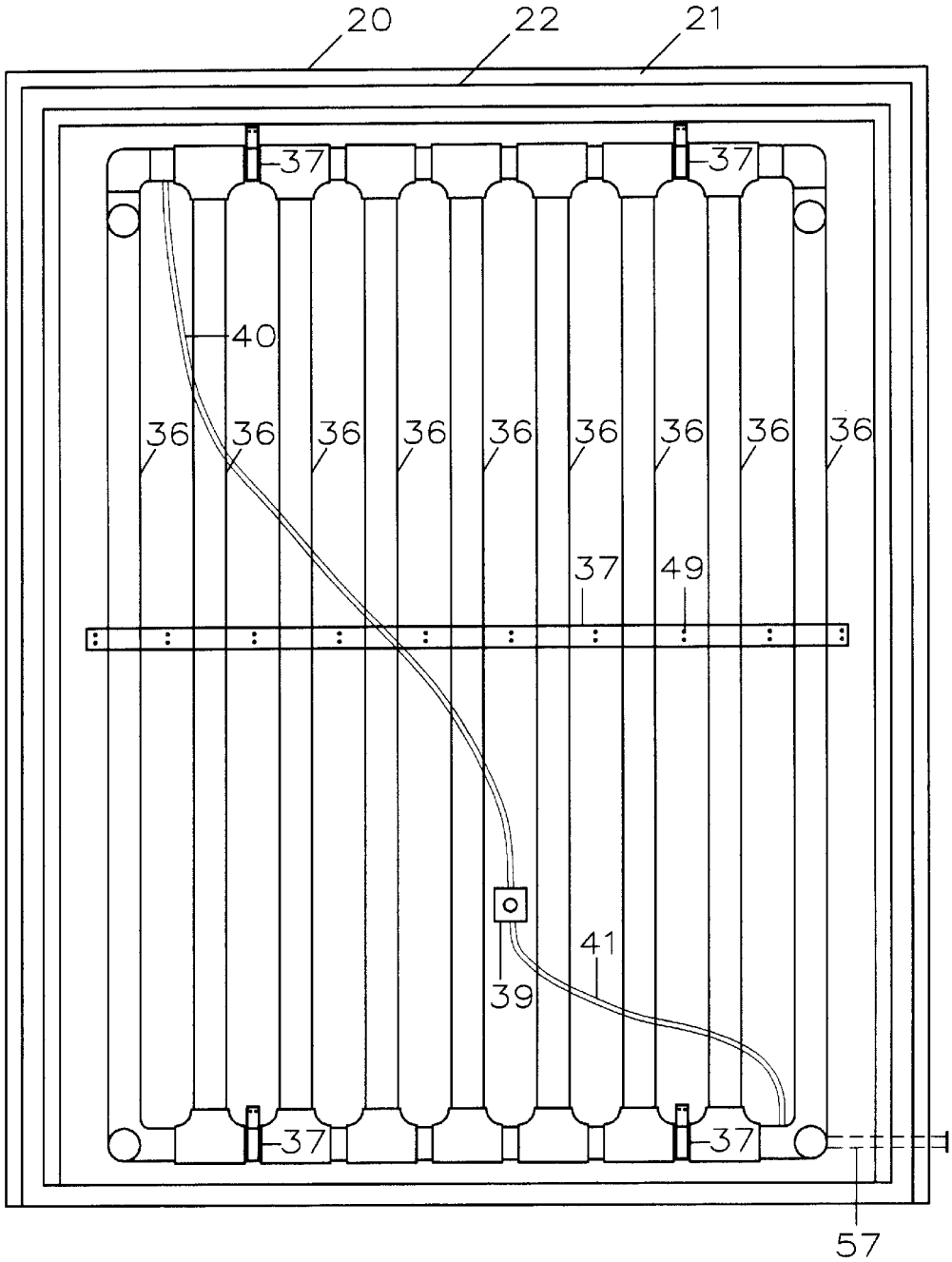
FIG. 5 is the detailed vertical sectional view taken along line 5—5 of FIG. 2, of the rear of the enclosure depicting the non-freezing liquid-filled pipe reservoir, the interconnecting conduits along with the temperature extractor, the cut view of the side walls construction and supporting components attaching the liquid-filled pipe reservoir to the rear wall of the enclosure.
Figure 8L:
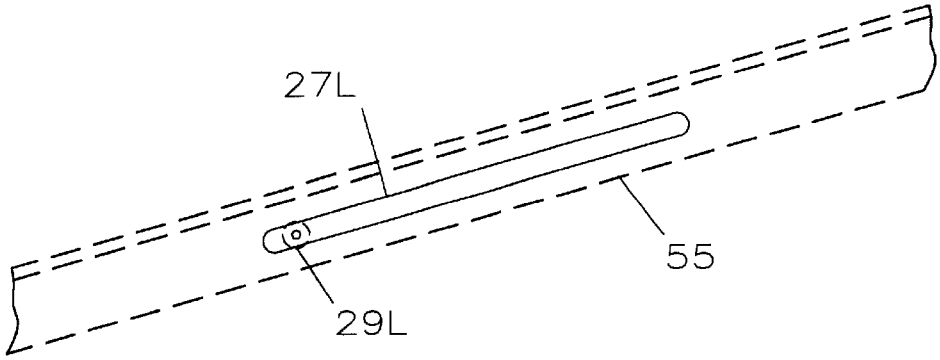
FIG. 8L is a sectional view taken along the line 8L—8L of FIG. 4, showing the left view of the slot in which the fixed swivel lug of the enclosure roof tilting glazed section travels.
Figure 8R:
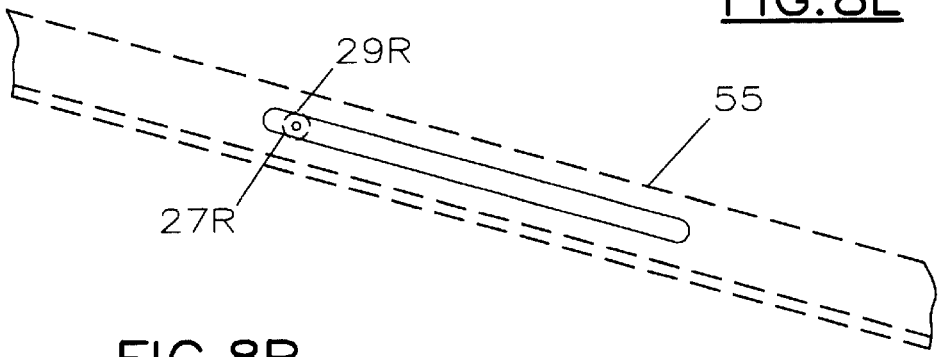
FIG. 8R is a sectional view taken along line 8R—8R of FIG. 4, showing the right side of the slot in which the fixed swivel lug of the enclosure roof tilting glazed section travels.
Figure 9:
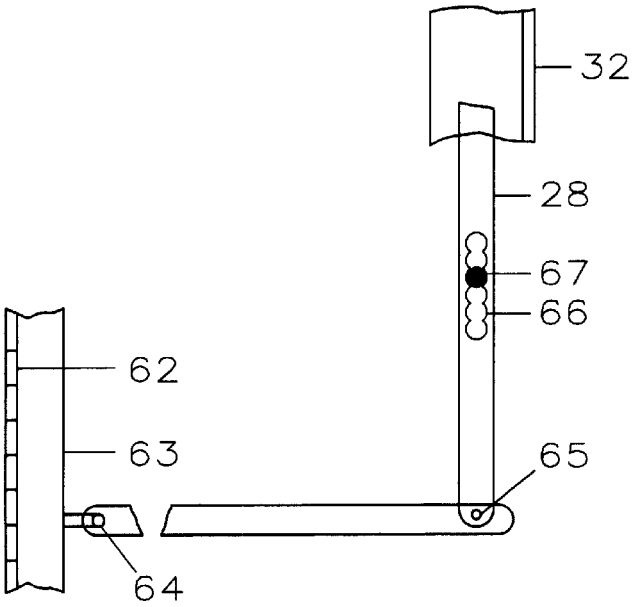
FIG. 9 is a broken out top sectional view of a portion of the operating linkage as shown in FIG. 3, depicting selective spaces to accommodate the pivot axis of the fulcrum advantaged lug.
Figures 10, 11:
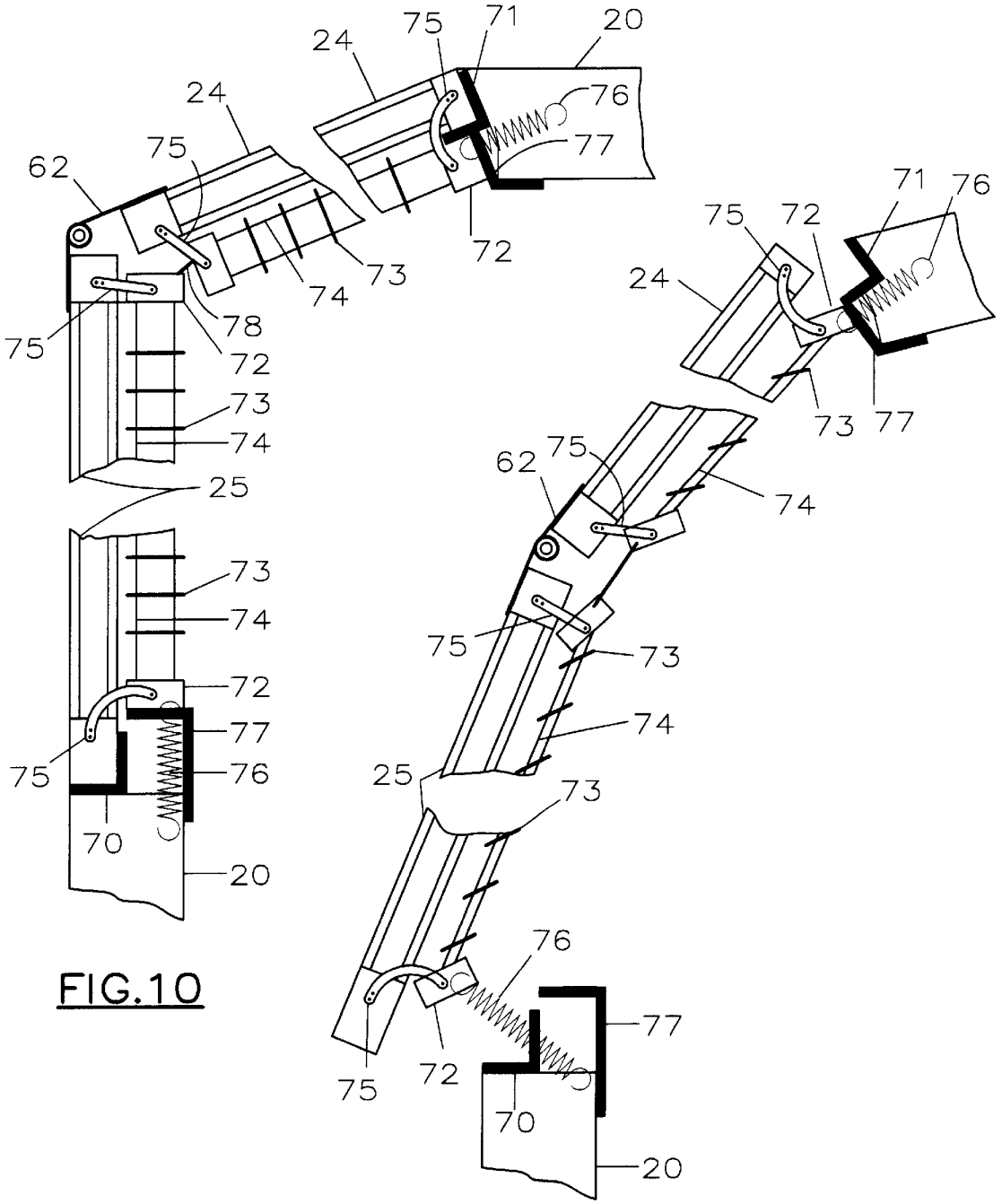
FIG. 10 is a detailed vertical sectional view of panels 24 and 25 in the unvented-closed position showing the attached light reflecting horizontal slat blinds in the open position.
FIG. 11 is a detailed vertical sectional view of panels 24 and 25 in the vented-open position showing the attached light reflecting horizontal slat blinds in the closed position.

The principal functional components of the temperature control zone enclosure are depicted in FIGS. 1–11. In the perspective view of the enclosure in FIG. 1, exterior 20, the enclosure is provided on three sides, part of the top or roof and a portion of the front with insulated sections impervious to varying weather conditions. Most of the top or roof 24, is a rectangular dual-glazed window and window frame, while most of the front 25, consists of a rectangular dual-glazed window and window frame, with both glazed section frames being connected by hinge 62. In operation, the enclosure remains unvented when the interior temperature remains below 68 degrees F., however, as the interior temperature rises above 75 degrees F., the enclosure is vented. Venting is done when the temperature sensing operating device inside the enclosure exerts a force on 24 and 25 at the point of hinge 62 causing both panels to tilt inwardly causing the uppermost end of 24 and the lowermost end of 25 to swing outwardly. Panels 24 and 25 return to the unvented position by gravitational means as the temperature control device movable arm returns to the original position. In the schematic of FIG. 2, the dual-glazed panels 24 and 25 are shown in closed position, 26R and 26L are the pivot pins for 25, while on FIG. 4, 29R and 29L are the fixed pivot pins for 24. The detailed operation and components that cause movable panels 24 and 25 to swivel are depicted in FIGS. 3 and 9. 36 are pipe sections containing the non-freezing liquid, 37 are the clamps fastening the pipe sections 36 to the enclosure wall with fastening means 49, while 40 and 41 are the conduits connecting pipe section 36, to the temperature extractor which is further detailed in FIGS. 6 and 7. 19 represents concrete piers to which the enclosure is secured. 55 is the representative frames of the movable panels 24 and 25 attached to the enclosure frame. 56 is a top air vent and fill valve and 57 is a drain valve for pipe sections 36. 58 is the phantom outline of a typical compressor/condenser ordinarily within the enclosure. in the bottom view of the temperature activated operating mechanism within the enclosure depicted in FIG. 3, 43 is a U-bolt attached to the juncture of movable panels 24 and 25 and connected to the first rigid member 30, which in turn is connected by pivot means to the second rigid member 28. Second rigid member 28 swings on a fulcrum mechanical advantaged lug pivot point attached to 32 which is the L-angle connected to both sides of the enclosure and which serves as a base for the operating mechanism. 31, the temperature sensing operating device, is in turn connected to the second rigid member 28 by pivot means and is mounted on the L-angle 32. The solid lines of the operating mechanism linkage depict the position of such linkage when movable panels 24 and 25 are in a closed unvented position. The phantom lines, depict the position of such linkage when movable panels 24 and 25 are in the open vented position. In FIG. 4, the front interior portion of the enclosure is shown depicting the top dual-glazed section 24 and the vertical dual-glazed section 25, with pivot points 29R and 29L for top section 24, and 26R and 26L for the front vertical section. As sections 24 and 25 are operated by the mechanism shown as 31 and 28, the lugs shown as pivot points 29R and 29L for the top section 24 change position in slot 27R and 27L as further detailed in FIGS. 8R and 8L. 32 is the L-angle mounted on each side of the enclosure that serves as the mounting base for the operating mechanism 31 and 28. 21 and 22 refer to the enclosure frame and insulation and 20 depicts the exterior and interior weather impervious material that covers the enclosure walls framing and insulation. FIG. 5, is a rear view of the enclosure interior again depicting 20 as the enclosure wall covering, 21 as the insulation, and 22 as the enclosure frame. The non-freezing liquid-filled pipe sections are shown as 36, the fastening straps as 37, the attaching means as 49, while 40 and 41 are shown as conduits connecting the temperature extractor 39 to pipe section 36. FIG. 6, illustrates in detail the temperature extracting device 39, constructed of the most efficient temperature transmission material, 38 represents the main piping from the compressor/condenser to the interior of the facility or building, while 40 and 41 are the interconnected conduits carrying tempered liquid to pipe sections 36, 45 depicts the insulated space between housing 39 and 46, 47 illustrates the temperature extracting coiled piping, 48 shows the hinge for housings 39 and 46 to be opened for installation or removal and 44 is a lock screw to keep the housings in place. FIG. 7, as a plan view of the temperature extractor, again illustrates 38 as the main piping from the compressor/condenser to the interior of the facility or building, 46 as the inner housing and 47 as the temperature extracting coiled piping. 50 is the hold-down strap fastening 47 to the inner housing with fastening means 51. FIGS. 8R and 8L depict slots 27R and 27L in window-like frame 55 to allow travel of fixed pivot pins 29R and 29L. FIG. 9, depicts 28 as the second rigid member of the operating mechanism linkage, 32 the L-angle support, 62 as the exterior hinge connecting both the top 24 and front 25 movable panels, 63 as the movable panel frame, 64 is the frame attachment for the operating mechanism linkage, 65 is the pivot pin point, while 67 depicts the fulcrum pivot lug and 66 illustrates a series of positions to fit and re-position 28 on the fulcrum pivot lug to increase or decrease the mechanical advantage to operate movable panels 24 and 25. In FIGS. 2, 10 and 11, 70 and 71 are the L-angled seats for panels 24 and 25 when in an unvented-closed position. FIG. 10 depicts panels 24 and 25 in an unvented-closed position while 72 is shown as the horizontal slat blind end housings with swivel pins, 73 are the blind slats (typical) attached to lineage 74 connected to 72 at both ends. 75 are the brackets anchored at the end of panel 24 and 25 that receives and allows the pin ends of 72 to swivel. The retracting springs 76, attached to 20 and 72 cause 72 to seat on brackets 77 which are perpendicular to 24 and 25. 78 is an adjustable chain attached to the bottom end of 72 on panel 24 and top end of 72 on panel 25 as a linear fixed connection. FIG. 11 depicts 24 and 25 in a vented open position while 72 and 73 are shown at an oblique angle resulting from the tension pulling action by the linear fixed chain connection 78 as 24 and 25 move to the open position. The springs 76 are shown as extended and exerting a pulling force on 72. In FIG. 4, 79 illustrates a partial cut view of the open horizontal slat blinds, 72 and 73 of FIG. 10, while panels 24 and 25 are in the unvented-closed position.

I claim:

1. A temperature control system to maintain optimum operating temperature for exterior compressors/condensers used to heat and/or cool the air in the interior of a building or facility consisting of a variable sized square or rectangular air temperature control zone enclosure housing an exterior compressor/condenser used to heat and/or cool a building or facility with attachments to ground or structural building surface bearing means, including exterior weather impervious material covering a portion of the top or roof, which is a slanted glazed section resting on the surrounding frame and a partially flat surface area toward the back, that material also covers the back, two sides and a portion of the front with solid insulation sandwiched between that outer covering and a similar weather impervious material on the interior, with most of the slanted top and front surfaces enclosed by dual-glazed metal framed movable hinged panels coupled to an interior set of rigid horizontally operated levers with mechanical fulcrum advantage attached to the temperature sensing operating device that opens or closes the movable dual-glazed panels in concert with the opening or closing of light-reflecting horizontal slat blinds, as the temperature within the enclosure rises or falls, with the enclosure being further equipped with temperature modifying means comprising:

(a) light-reflecting horizontal slat blinds to minimize or maximize the amount of natural light entering the enclosure;

(b) interconnected sections of piping filled with non-freezing liquid which absorbs and retains for varying periods of time the atmospheric heat from natural light that infiltrates the enclosure through the top and front dual-glazed movable panels;

(c) said non-freezing liquid in interconnected sections of piping also receiving supplemental continuous heating or cooling transmitted in communication between the main pipe line that enters the building or facility from the compressor/condenser and the interconnected sections of piping containing the non-freezing liquid;

(d) a heat extracting device mounted on the main line that enters the building or facility from the compressor/condenser that transmits temperature from that main line via tubing connected between said heat extracting device and the interconnected sections of piping containing the non-freezing liquid;

(e) a heat extracting device consisting of high temperature transmission material equipped with hinged and latching means to allow opening and closing for installation on the main tubing line in communication with the exterior compressor/condenser and the facility or building;

(f) a series of clamp supports used to attach the interconnected piping sections containing the non-freezing liquid to the sides and back of the interior walls of the enclosure along with means to fill and drain the contents of the interconnected piping sections;

(g) means to attach the enclosure to ground level or facility bearing surfaces to provide a maximum separation of the air in the enclosure from that of the exterior atmosphere.

2. The temperature control zone enclosure according to claim 1 wherein the air flow from the operating compressor/condenser circulates within the enclosure to cause the temperature sensing operating device to either open or close the movable glazed panels of the enclosure.

3. The temperature control zone enclosure according to claim 1 wherein the attached movable glazed panels of the enclosure are equipped with means to automatically control the amount of natural light that contribute to temperature changes within the enclosure.

4. The temperature control zone enclosure according to claim 1 wherein the compressor/condenser is sheltered from the natural elements during any and all inclement weather conditions.

5. The temperature control zone enclosure according to claim 1 wherein warming or cooling of the air is caused in part by air circulated in and around the interconnected piping sections containing the non-freezing liquid.

6. The temperature control zone enclosure according to claim 1 wherein use of the enclosure will result in minimizing electrical power use and cause the efficient operational "life-expectancy" of the compressor(s)/condenser(s) to be extended.

* * * * *